US010147573B1

(12) United States Patent
Su et al.

(10) Patent No.: US 10,147,573 B1
(45) Date of Patent: Dec. 4, 2018

(54) REFLOWABLE THERMAL FUSE

(71) Applicant: POLYTRONICS TECHNOLOGY CORP., Hsinchu (TW)

(72) Inventors: Tsungmin Su, Hsinchu (TW); Tongcheng Tsai, Tainan (TW); David Shau Chew Wang, Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 21 days.

(21) Appl. No.: 15/662,935

(22) Filed: Jul. 28, 2017

(51) Int. Cl.

| | |
|---|---|
| ***H01H 37/76*** | (2006.01) |
| ***H01H 37/34*** | (2006.01) |
| ***H01H 37/64*** | (2006.01) |
| *H01H 85/041* | (2006.01) |

(52) U.S. Cl.
CPC ..... *H01H 37/761* (2013.01); *H01H 37/34* (2013.01); *H01H 37/64* (2013.01); *H01H 2037/763* (2013.01); *H01H 2085/0414* (2013.01)

(58) Field of Classification Search
CPC ..... H01H 37/64; H01H 37/761; H01H 2037/762–2037/763; H01H 2085/0412–2085/0414
USPC ..... 337/407
See application file for complete search history.

(56) References Cited

U.S. PATENT DOCUMENTS 5,084,691 A * 1/1992 Lester ..... H01H 61/00 337/166
5,793,274 A * 8/1998 Kelly ..... H01H 85/36 337/141
6,269,745 B1 * 8/2001 Cieplik ..... H01H 85/046 102/202.5
6,373,371 B1 * 4/2002 Doerrwaechter .... H01H 37/761 29/623
8,581,686 B2 11/2013 Galla et al.
(Continued)

FOREIGN PATENT DOCUMENTS

| | | | |
|---|---|---|---|
| FR | 2914108 | A1 | 9/2008 |
| TW | 201545193 | A | 12/2015 |
| TW | 1590283 | B | 7/2017 |

*Primary Examiner* — Anatoly Vortman
*Assistant Examiner* — Jacob Crum
(74) *Attorney, Agent, or Firm* — Muncy, Geissler, Olds & Lowe, P.C.

(57) ABSTRACT

A reflowable thermal fuse comprises a conduction element with first and second elastic portions, a sensor, a restraining element, a heating element and mounting pads. The first elastic portion is adapted to apply force on the conduction element in an activated state of the thermal fuse. The sensor is in mechanical communication with the first elastic portion of the conduction element. The restraining element is adapted to secure the second elastic portion of the conduction element and thereby prevent the second elastic portion from applying force on the conduction element in an installation state of the thermal fuse. Application of an activating current through the heating element causes heat generated and transferred to the restraining element and makes the restraining element to lose resilience, thereby releasing the second elastic portion and placing the thermal fuse in the activated state. The sensor loses its ability to hold the first elastic portion in place and allows the conduction element to open during a subsequent fault condition.

13 Claims, 5 Drawing Sheets

(56) References Cited

U.S. PATENT DOCUMENTS

| | | | | |
|---|---|---|---|---|
| 2010/0245022 | A1* | 9/2010 | Galla | H01H 37/761 337/159 |
| 2010/0245027 | A1* | 9/2010 | Matthiesen | H01H 37/761 337/297 |
| 2011/0050384 | A1* | 3/2011 | Chen | H01H 37/761 337/296 |
| 2012/0268854 | A1* | 10/2012 | Schmidtlein | H01H 37/761 361/103 |
| 2015/0340181 | A1* | 11/2015 | Ho | H01H 37/761 337/407 |

* cited by examiner

REFLOWABLE THERMAL FUSE

BACKGROUND OF THE INVENTION

(1) Field of the Invention

The present application relates to a thermal fuse, and more specifically, to a reflowable thermal fuse.

(2) Description of the Related Art

With the advancement of scientific technology, electrical and electronic products become more diverse and complicated over time. The applicable circuit protection devices are not limited to traditional glass tube fuses, and have been devised to include a variety of electronic devices. The reliability and safety of the electronic products of new generations are highly demanded, and thus people pay close attention to the progresses of applicable circuit protection devices.

With the need of circuit protection for diverse electronic products, the use of over-current protection devices or over-voltage protection devices increases over time. In statistics, 75% of malfunction of electronic products may be caused by over-current or over-voltage events. In consideration of safety requirements of the electronic products, circuit protection devices have been widely applied thereto.

Because traditional glass tube fuses take up relatively large space and the electrodes are not suitable for being applied to circuit boards, surface-mount device (SMD) type thermal fuses with small volume have been developed. The thermal fuses operate like glass tube fuses; that is, the thermal fuses are conductive in normal operation, and will change to an open-circuit state when ambient temperature exceeds a threshold value. In other words, the thermal fuses switch from conductive state to non-conductive state if a temperature reaches the threshold value in an event that over-current passing through the thermal fuses or adjacent devices heats up due to malfunction.

One disadvantage of existing thermal fuses is that during installation of a thermal fuse mounted onto a circuit board, it has to prevent the thermal fuse from reaching the threshold temperature. Otherwise, the thermal fuse changes to an open-circuit state and thus it cannot be used. Therefore, ordinary thermal fuses cannot be mounted onto circuit boards through reflow ovens since reflow ovens usually operate at high temperatures around 230° C. to 260° at which the thermal fuses change to open-circuit state.

The U.S. Pat. No. 8,581,686 devised a reflowable thermal fuse 10, as shown in FIG. 1, comprising a conduction element 11 through which a load current flows between two mounting pads 14 under normal operating conditions as shown. The conduction element 11 has resilience going upward and nevertheless is restrained to the mounting pads 14 by sensors 12 which may comprise solder. During reflow, sensors 12 melt and therefore cannot hold the conduction element 11 in place. To resolve the problem, a string-type restraining element 13 is employed to exert tension for holding the conduction element 11 in place during reflow. During normal operations, a load current may flow through the arc portion of the conduction element 11 between the mounting pads 14. After blowing the restraining element 13 by electricity such as a current of 2 A-5 A, the conduction element 11 is held in place via the sensors 12. As a result, the reflowable thermal fuse 10 is in an activated state. During a subsequent fault condition, e.g., over-current, excessive heat causes the sensors 12 to lose the ability to hold the conduction element 11 in place and the conduction element 11 subsequently springs open as shown. The restraining element 13 may be made of conductive material such as copper, stainless or alloy. The wire diameter of the restraining element 13 has to be taken into account to ensure a current applied thereto can blow and sever the restraining element 13. Heaters 15 are disposed below the sensors 12 to cause the conduction element 11 to lose resilience more quickly resulting in opening of the conduction element 11. However, the thermal fuse 10 has a complex structure in which the restraining element 13 and the sensors 12 activate with different mechanisms. Moreover, the restraining element 13 is usually a string to hold the conduction element 11; however, the tension or strength of the string may decrease over time to lose the ability in holding the conduction element 11 during reflow.

SUMMARY OF THE INVENTION

To resolve the problems mentioned above, the present application provides a reflowable thermal fuse of a simple structure without a string-type restraining element such that a degradation of the string-type restraining element is avoided. Moreover, the heating element is electrically independent and can be activated by a relatively small current.

In an exemplary embodiment of the present application, a reflowable thermal fuse comprises a conduction element, a sensor, a restraining element, a heating element and a plurality of mounting pads. The conduction element has a first elastic portion and a second elastic portion, the first elastic portion being adapted to apply force on the conduction element in an activated state of the thermal fuse. The sensor is in mechanical communication with the first elastic portion of the conduction element. The restraining element is adapted to secure the second elastic portion of the conduction element and thereby prevent the second elastic portion from applying force on the conduction element in an installation state of the thermal fuse. The mounting pads enable surface mounting the thermal fuse. Application of an activating current through the heating element causes heat generated and transferred to the restraining element and makes the restraining element to lose resilience, thereby releasing the second elastic portion and placing the thermal fuse in the activated state. During a subsequent fault condition, the sensor loses its ability to hold the first elastic portion in place and allows the conduction element to open.

In an exemplary embodiment, the sensor loses resilience when an ambient temperature around the thermal fuse exceeds a threshold value and allows the conduction element to open under the force applied by the first elastic portion.

In an exemplary embodiment, the conduction element is a flexed structure with two arc portions corresponding to the first and second elastic portions.

In an exemplary embodiment, the heating element is electrically independent to the restraining element and the conduction element.

In an exemplary embodiment, first and second ends of the first elastic portion are in electrical communication with first and second mounting pads of the plurality of mounting pads to form a load current path of the thermal fuse.

In an exemplary embodiment, the second end of the first elastic portion connects to the second mounting pad through the sensor.

In an exemplary embodiment, a first end of the second elastic portion connects to the second mounting pad through the sensor, and a second end of the second elastic portion connects to a bonding plate disposed on the heating element through the restraining element.

In an exemplary embodiment, the sensor and the restraining element comprise solder.

In an exemplary embodiment, a melting temperature of the restraining element is higher than a reflow temperature in the installation state.

In an exemplary embodiment, the restraining element has a higher melting temperature than that of the sensor.

In an exemplary embodiment, the restraining element has a higher melting temperature than that of the sensor by 20-160° C.

In an exemplary embodiment, the heating element is a resistor device or a PTC device.

In an exemplary embodiment, the activating current is automatically switched off when the second elastic portion is released, In another exemplary embodiment of the present application, a reflowable thermal fuse comprises a conduction element, a sensor, a restraining element, a heating element and a base with a plurality of mounting pads that enable surface mounting the thermal fuse. The conduction element has a first elastic portion and a second elastic portion, the first elastic portion being adapted to apply force on the conduction element in an activated state of the thermal fuse. The sensor is in mechanical communication with the first elastic portion of the conduction element. The restraining element is adapted to secure the second elastic portion of the conduction element and thereby prevent the second elastic portion from applying force on the conduction element in an installation state of the thermal fuse. First and second mounting pads of the plurality of mounting pads are disposed at least partially outside of the underside of the base, and first and second ends of the first elastic portion are in electrical communication with the first and second mounting pads to form a load current path of the thermal fuse. Application of an activating current through the heating element causes heat generated and transferred to the restraining element and makes the restraining element to lose resilience, thereby releasing the second elastic portion and placing the thermal fuse in the activated state. The sensor loses its ability to hold the first elastic portion in place and allows the conduction element to open during a subsequent fault condition.

In an exemplary embodiment, the thermal fuse further comprises a housing engaging with the base to form an interior space for accommodating the conduction element, the sensor, the restraining element and the heating element.

In the present application, the sensor and the restraining element may comprise solder, which activates upon the same mechanism, so that the thermal fuse structure can be simplified. Instead of string-type restraining element used in the prior art, the restraining element of the present application can avoid tension degradation of the restraining element to firmly and accurately secure the conduction element in place.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
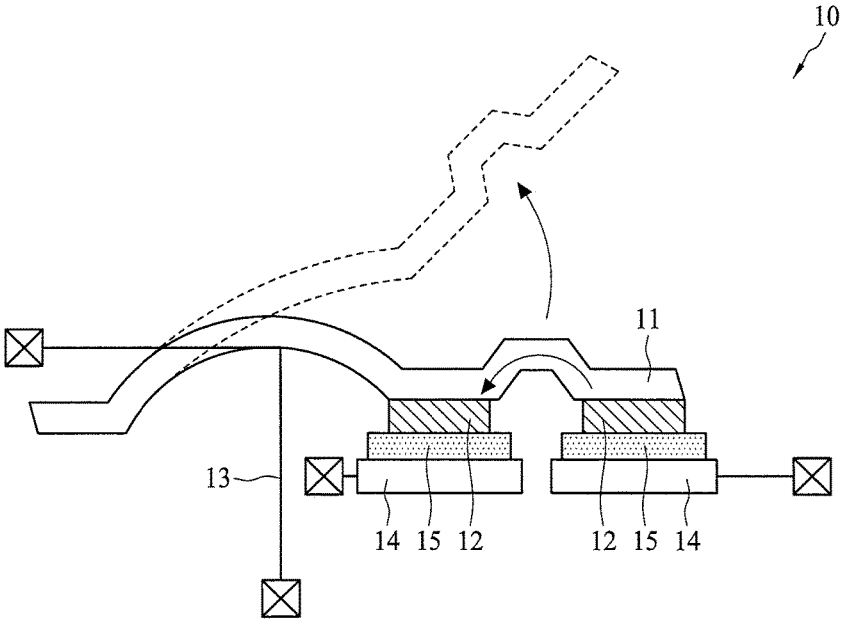
FIG. 1 (Prior Art)
FIG. 1 shows a known reflowable thermal fuse.
Figure 2:
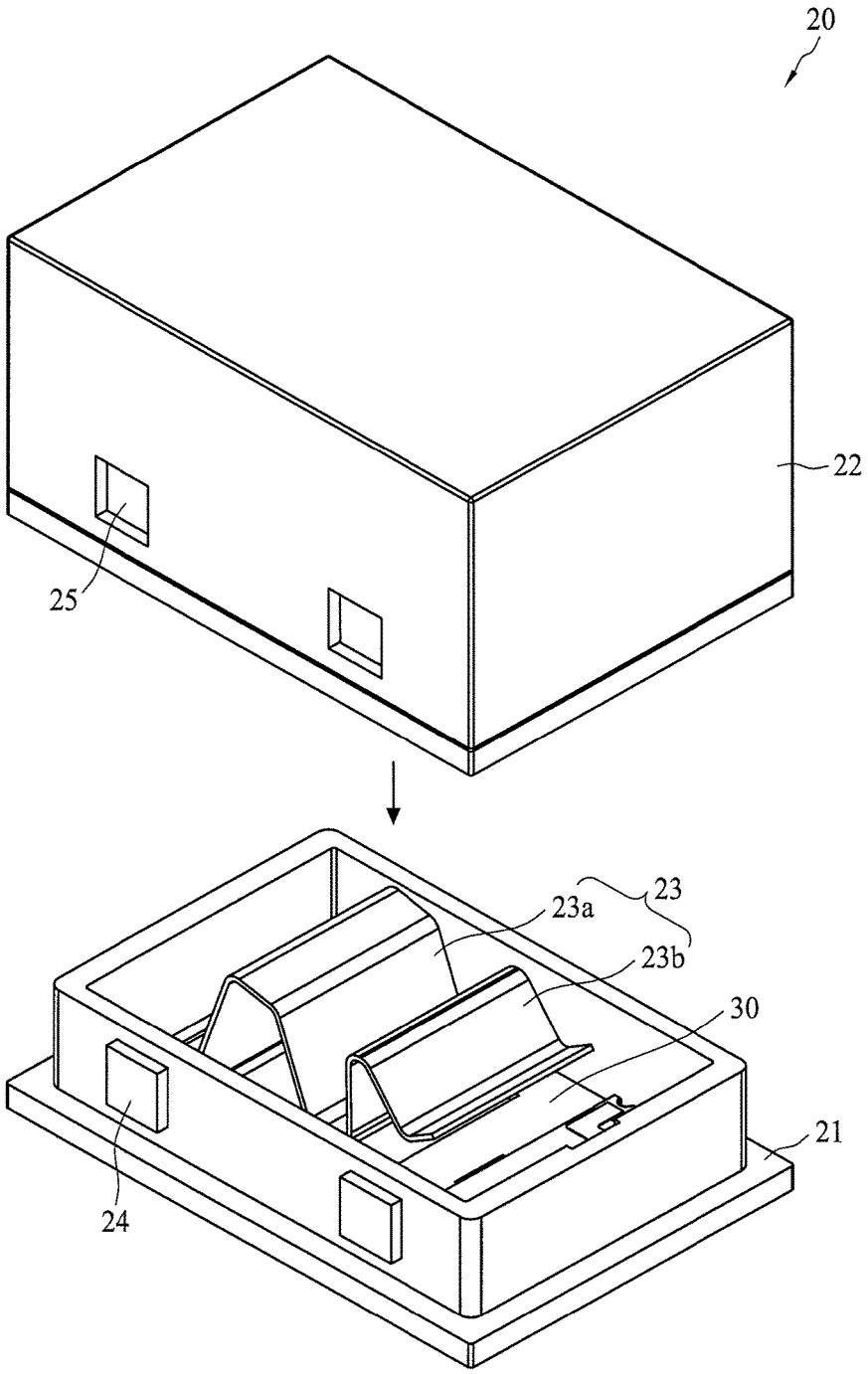
FIG. 2 shows a reflowable thermal fuse in accordance with an embodiment of the present application.

FIG. 2 shows a reflowable thermal fuse 20, which is in an activated state, in accordance with an embodiment of the present application. A base 21 is associated with a housing 22 to form an interior space for accommodating essential elements of the thermal fuse 20. The conduction element 23 is disposed on the base 21 and comprises a first elastic portion 23*a* and a second elastic portion 23*b*. The sidewalls of the base 21 are provided with protrusions 24 which are able to engage with notches 25 on the sidewalls of the housing 22 for combination. The conduction element 23 may be made of a metal sheet flexed to form two arc portions corresponding to the first elastic portion 23*a* and the second elastic portion 23*b*. The first and second elastic portions 23*a* and 23*b* in arc shapes provide resilience that is able to apply force to the conduction element 23. A bonding plate 30 disposed on the base 21 is adapted to secure the second elastic portion 23*b*.

Figure 3:
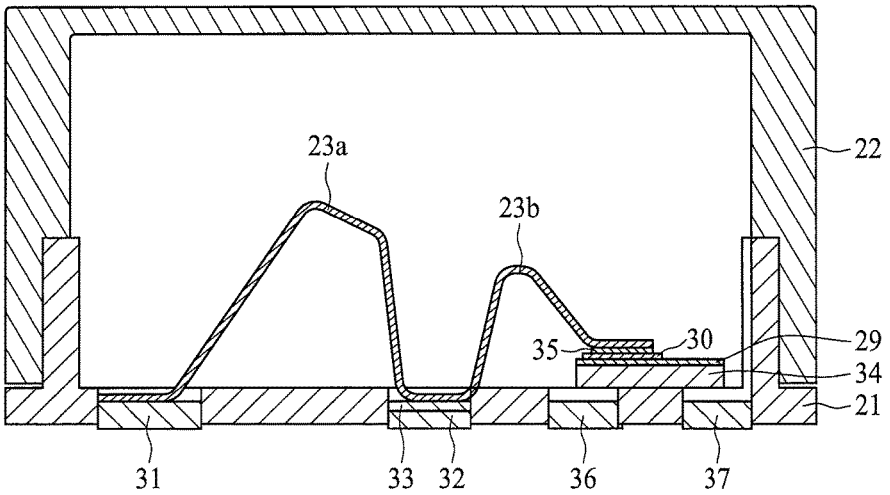
FIG. 3 through FIG. 5 show the reflowable thermal fuse of the present application in different states.
Figure 6:
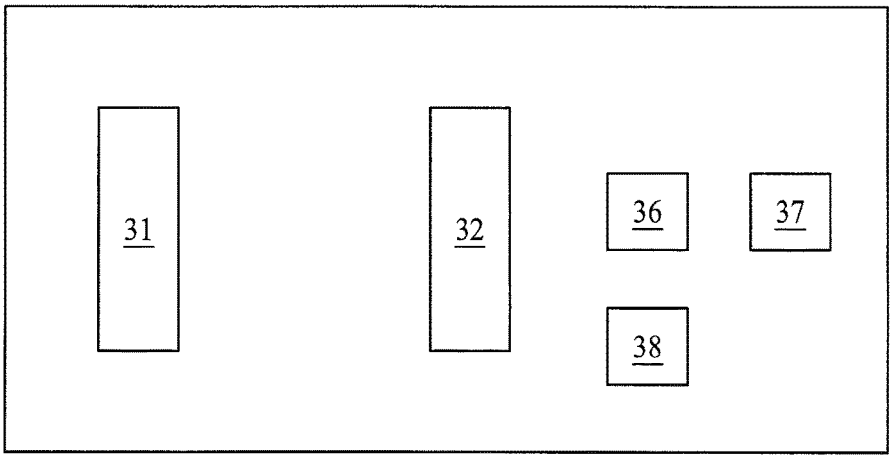
FIG. 6 shows a bottom view of the reflowable thermal fuse in accordance with an embodiment of the present application.

FIG. 3 shows a cross-sectional view of the reflowable thermal fuse 20 in an installation state. The base 21 comprises a plurality of mounting pads that enable surface mounting the thermal fuse 20 onto a circuit board (not shown). First and second ends of the first elastic portion 23*a* are in electrical communication with a first mounting pad 31 and a second mounting pad 32, respectively, to form a load current path of the thermal fuse 20. The first and second mounting pads 31 and 32 are disposed at least partially outside of the underside of the base 21, as shown in FIG. 6 illustrating the underside of the base 21, for surface mounting. The first end of the first elastic portion 23*a* may connect to the mounting pad 31 by spot-welding. The second end of the first elastic portion 23*a* connects to the second mounting pad 32 through a sensor 33. That is, the sensor 33 is in mechanical communication with the first elastic portion 23*a* of the conduction element 23. As a continuous member of the conduction element 23, the second end of the first elastic portion 23*a* is substantially equivalent to a first end of the second elastic portion 23*b* nearby. Therefore, the first end of the second elastic portion 23*b* also connects to the second mounting pad 32 through the sensor 33. A second end of the second elastic portion 23*b* is secured to the bonding plate 30 disposed on a heating element 34 through a restraining element 35. In this embodiment, an insulating layer 29 such as a glaze layer is laminated between the bonding plate 30 and the heating element 34 for insulation. The heating element 34 is electrically connected to electric pads 36 and 37 to allow application of a current flowing therethrough. In this embodiment, the heating element 34 is electrically independent to the restraining element 35 and the conduction element 23, so as to avoid electric conflict problems. Moreover, a relatively small current or power is able to activate the heating element 34 to melt the restraining element 35, compared to a large current for blowout of the restraining element. The heating element 34 may be a resistor device or a PTC device.

In an embodiment, the sensor 33 may comprise solder, and the restraining element 35 comprises solder also. The restraining element 35 has a melting temperature higher than a reflow temperature of the thermal fuse 20. Accordingly, the restraining element 35 can hold the second elastic portion 23*b* in place during reflow, thereby preventing the second elastic portion 23*b* from applying force on the conduction element 23 in an installation state of the thermal fuse 20. In an embodiment, the restraining element 35 has a higher melting temperature than the melting temperature of the sensor 33. Because no deformation of the conduction element 23, the sensor 33 is held in place even it is melted or loses its resilience during reflow.

In an embodiment, the restraining element 35 has a melting temperature about 240-290° C., higher than reflow temperature about 230-260° C. The restraining element 35 may comprises solder of Sn—Cu, Sn—Bi—Ag, Pb—Sn—Ag, Pb—In—Ag alloys. The sensor 33 has a melting temperature about 150-230° C., and may comprise solder of Sn—In—Ag, Sn—Ag—Cu, Sn—Pb, Sn—Pb, or Sn—In alloys. The restraining element 35 usually has a higher melting temperature than that of the sensor 33 by 20-160° C.

Figure 4:
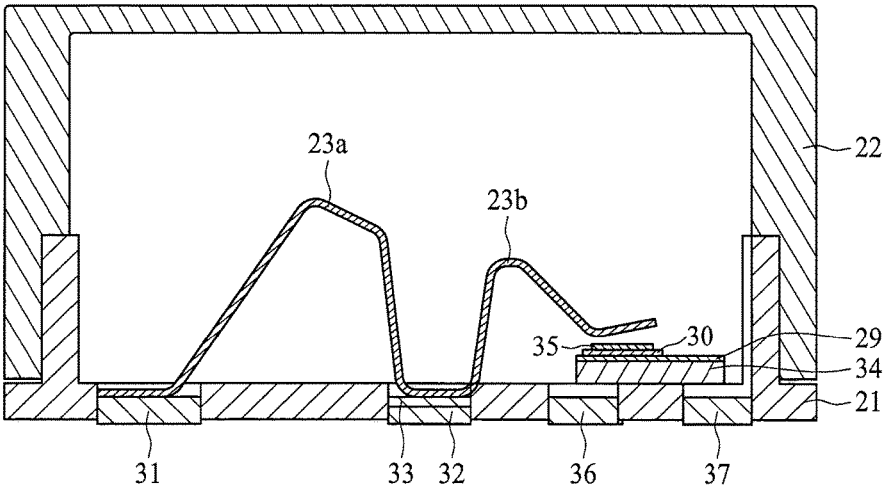

After reflow, a current, such as 1.5 A which may be generated by 3-60V and 4-200 W, is applied to the heating element 34 to generate heat, and the heat is transferred to the restraining element 35 thereafter. As a consequence, the restraining element 35 is heated to lose resilience and thereby releases the second elastic portion 23*b*, as shown in FIG. 4, to place the thermal fuse 20 in an activated state. In this activated state, the second elastic portion 23*b* is separated from the bonding plate 30, and the first elastic portion 23*a* applies force on the conduction element 23 though it is still restrained by the sensor 33. As shown in FIG. 6, a testing pad 38 electrically connecting to the bonding plate 30 may be further provided on the underside of the base 21. A resistance measurement between the pads 32 and 38 may be conducted to ensure that the electric path of the second elastic portion 23*b* between the pads 32 and 38 is open, indicating the separation of the second elastic portion 23*b* from the bonding plate 30.

Figure 5:
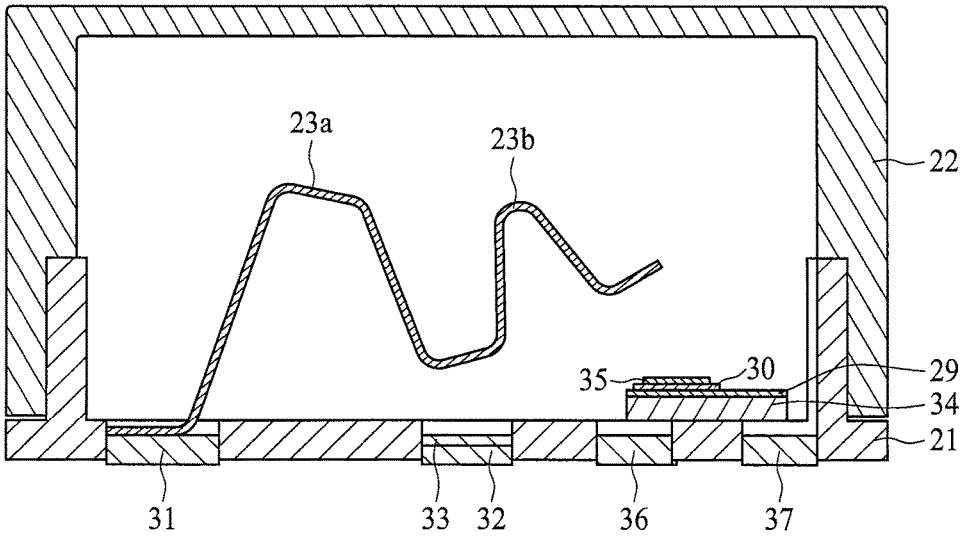

During a fault condition such as an over-current event, the sensor 33 loses its ability to hold the first elastic portion 23*a* in place and allows the conduction element 11 to open, as shown in FIG. 5. In addition, the sensor 33 loses resilience when an ambient temperature around the thermal fuse 20 exceeds a threshold value, i.e., overheat, thereby allowing opening of the conduction element 23 under the force applied by the first elastic portion 23*a*.

Figure 7:
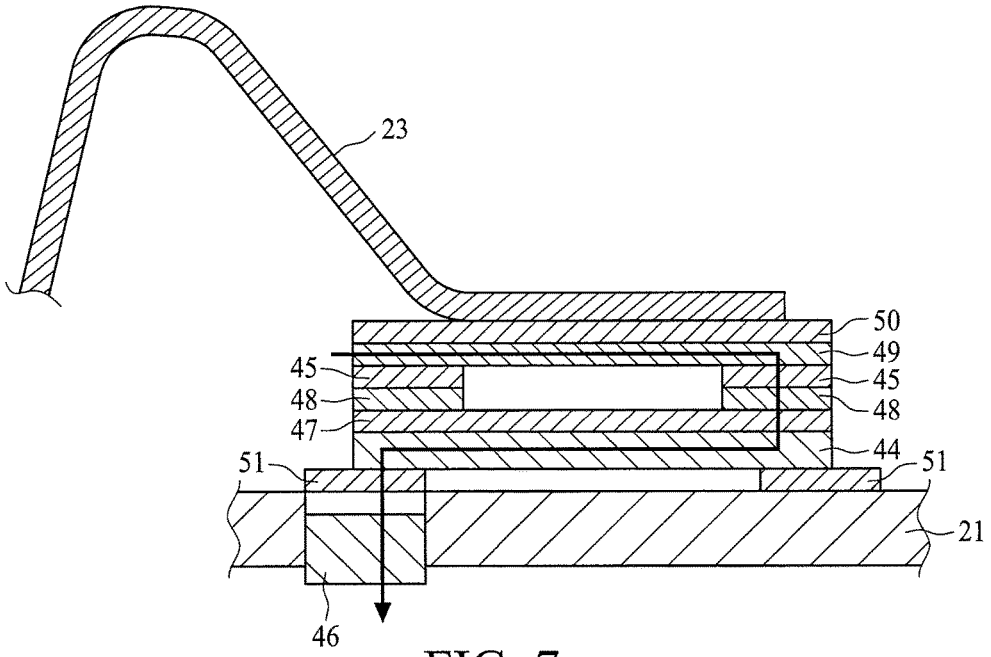
FIG. 7 shows a part of a reflowable thermal fuse in accordance with another embodiment of the present application.
Figure 8:
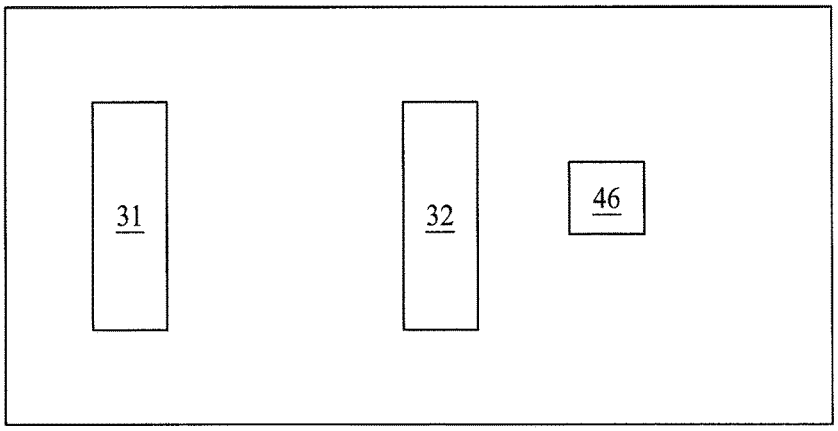
FIG. 8 shows a bottom view of the reflowable thermal fuse of FIG. 7.

A reflowable thermal fuse in accordance with another embodiment is shown in FIG. 7 and FIG. 8, in which FIG. 7 shows the detail of the portion of a restraining element of the reflowable thermal fuse and FIG. 8 shows a bottom view of the reflowable thermal fuse. In this embodiment, the first elastic portion and the second elastic portion of the conduction element 23 and the mounting pads 31 and 32 are the same as the embodiment shown in FIGS. 2 to 6. A heating element 44 connects to two electrodes 51 provided on the substrate 21 and an insulating layer 47 such as a glaze layer is disposed on the heating element 44. Two bonding plates 48 are disposed on the insulating layer 47, and an electrically conductive layer 49 such as a copper layer connects to the two bonding plates 48 by a restraining element 45 of two separate parts. The conduction element 23 is separated from the electrically conductive layer 49 by an insulating layer 50, e.g., an epoxy layer, laminated therebetween, by which the conduction element 23 is electrically independent to the restraining element 45. The electrically conductive layer 49 electrically connects to the mounting pad 32 through an electric path in the substrate 21. The right bonding plate 48 electrically connects to an end of the heating element 44, and another end of the heating element 44 electrically connects to a pad 46 on the underside of the substrate 21 through the electrode 51. The pad 46 is electrically grounded. As a result, an electric path including the mounting pad 32, the restraining to element 45, the heating element 44 and the pad 46 in order is formed, as shown in FIG. 7. After reflow, an activating current or an electric power of 10-20 W is applied to the mounting pad 32 to activate the heating element 44, and then the generated heat of the heating element 44 is transferred to the restraining element 45. When the restraining element 45 is heated to be melted or lose resilience, the restraining element 45 no longer holds the second elastic portion of the conduction element 23 in place, the conduction element 23 with the insulating layer 50 and the electrically conductive layer 49 is separated from the bonding plates 48 and the reflowable thermal fuse is in an activated state. The separation causes the opening of the electric path from the mounting pad 32 to the pad 46, and as a consequence the activating current through the heating element 44 is switched off automatically. In other words, the activating current through the heating element 44 is automatically switched off when the second elastic portion of the conduction element 23 is released. Therefore, if the activating current or the applying electric power is switched off, it indicates and ascertains the separation of the second elastic portion of the conduction element 23 from the bonding plates 48. There is no need to perform a resistance test as mentioned above.

In summary, the restraining element 35 or 45 holds the second elastic portion 23*b* in place during reflow, i.e., an installation state, and is heated to lose resilience after reflow to release the second elastic portion 23*b* and place the thermal fuse 20 in an activation state. During a fault condition such as over-current or over-heat, the sensor 33 loses its ability to hold the first elastic portion 23*a* in place and allows opening of the conduction element 23.

In the present application, the conduction element has the first and second elastic portions which are not released at the same time. The thermal fuse is in an activated state when the second elastic portion is released after reflow. During a fault condition, the first elastic portion is no longer held in place by the sensor. In other words, the second elastic element is activated or released before the first elastic element is activated or released. By the two-stage activation, the thermal fuse can be subjected to a reflow process without lost of the ability to secure conduction element. Without a string-type restraining element, a tension decay of the restraining element is not an issue and the thermal fuse structure can be simplified. Moreover, a relatively small current of, for example, less than 2 A can be used to release the second elastic portion of the conduction element.

The above-described embodiments of the present invention are intended to be illustrative only. Numerous alternative embodiments may be devised by persons skilled in the art without departing from the scope of the following claims.

What is claimed is:

1. A reflowable thermal fuse, comprising:

a conduction element with a first elastic portion and a second elastic portion, the first elastic portion applying force on the conduction element in an activated state of the thermal fuse;

a sensor in mechanical communication with the first elastic portion of the conduction element;

a restraining element securing the second elastic portion of the conduction element and thereby prevent the second elastic portion from applying force on the conduction element in an installation state of the thermal fuse;

a heating element; and a plurality of mounting pads that enable surface mounting the thermal fuse;

wherein first and second ends of the first elastic portion are in electrical communication with the first and second mounting pads of the plurality of mounting pads to form a load current path of the thermal fuse;

wherein the second end of the first elastic portion connects to the second mounting pad through the sensor;

wherein a first end of the second elastic portion connects to the second mounting pad through the sensor, and a second end of the second elastic portion connects to a bonding plate disposed on the heating element through the restraining element;

wherein application of an activating current through the heating element, causes heat generated and transferred to the restraining element, makes the restraining element to lose resilience, and thereby release the second elastic portion and place the thermal fuse in the activated state;

wherein the sensor loses its ability to hold the first elastic portion in place and allows the conduction element to open during a subsequent fault condition.

2. The reflowable thermal fuse of claim 1, wherein the sensor loses resilience when an ambient temperature around the thermal fuse exceeds a threshold value and allows the conduction element to open under the force applied by the first elastic portion.

3. The reflowable thermal fuse of claim 1, wherein the conduction element is a flexed structure with two arc portions corresponding to the first and second elastic portions.

4. The reflowable thermal fuse of claim 1, wherein the heating element is electrically independent to the restraining element and the conduction element.

5. The reflowable thermal fuse of claim 1, wherein the sensor and the restraining element comprise solder.

6. The reflowable thermal fuse of claim 1, wherein a melting temperature of the restraining element is higher than a reflow temperature in the installation state.

7. The reflowable thermal fuse of claim 1, wherein the restraining element has a higher melting temperature than that of the sensor.

8. The reflowable thermal fuse of claim 1, wherein the restraining element has a higher melting temperature than that of the sensor by 20-160° C.

9. The reflowable thermal fuse of claim 1, wherein the heating element is a resistor device or a PTC device.

10. The reflowable thermal fuse of claim 1, wherein the activating current is automatically switched off when the second elastic portion is released.

11. A reflowable thermal fuse, comprising:

a conduction element with a first elastic portion and a second elastic portion, the first elastic portion applying force on the conduction element in an activated state of the thermal fuse;

a sensor in mechanical communication with the first elastic portion of the conduction element;

a restraining element securing the second elastic portion of the conduction element and thereby prevent the second elastic portion from applying force on the conduction element in an installation state of the thermal fuse;

a heating element; and a base with a plurality of mounting pads that enable surface mounting the thermal fuse, first and second mounting pads of the plurality of mounting pads being disposed at least partially outside the underside of the base, first and second ends of the first elastic portion being in electrical communication with the first and second mounting pads to form a load current path of the thermal fuse;

wherein the second end of the first elastic portion connects to the second mounting pad through the sensor;

wherein a first end of the second elastic portion connects to the second mounting pad through the sensor, and a second end of the second elastic portion connects to a bonding plate disposed on the heating element through the restraining element;

wherein application of an activating current through the heating element, causes heat generated and transferred to the restraining element, makes the restraining element to lose resilience, and thereby release the second elastic portion and place the thermal fuse in the activated state;

wherein the sensor loses its ability to hold the first elastic portion in place and allows the conduction element to open during a subsequent fault condition.

12. The reflowable thermal fuse of claim 11, further comprising a housing engaging with the base to form an interior space for accommodating the conduction element, the sensor, the restraining element and the heating element.

13. The reflowable thermal fuse of claim 11, wherein the activating current is automatically switched off when the second elastic portion is released.

* * * * *